US012467182B2

(12) United States Patent
Damtew

(10) Patent No.: US 12,467,182 B2
(45) Date of Patent: Nov. 11, 2025

(54) SYSTEMS AND METHODS FOR DISPENSING AN ADDITIVE FOR A WASHING MACHINE APPLIANCE

(71) Applicant: Haier US Appliance Solutions, Inc., Wilmington, DE (US)

(72) Inventor: FikreAdam Abebe Damtew, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 159 days.

(21) Appl. No.: 18/495,148

(22) Filed: Oct. 26, 2023

(65) Prior Publication Data

US 2025/0137181 A1 May 1, 2025

(51) Int. Cl.

| | |
|---|---|
| ***D06F 33/37*** | (2020.01) |
| ***D06F 39/02*** | (2006.01) |
| *D06F 103/00* | (2020.01) |

(52) U.S. Cl.
CPC ..... *D06F 33/37* (2020.02); *D06F 39/02* (2013.01); *D06F 2103/00* (2020.02)

(58) Field of Classification Search
CPC ..... D06F 33/37
See application file for complete search history.

(56) References Cited

U.S. PATENT DOCUMENTS

| | | | |
|---|---|---|---|
| 8,713,737 B2 | 5/2014 | Ihne et al. | |
| 11,162,207 B2 | 11/2021 | Bueno et al. | |
| 2022/0243378 A1* | 8/2022 | Yoon | D06F 33/32 |

FOREIGN PATENT DOCUMENTS

| | | | |
|---|---|---|---|
| CN | 114197171 | A | 3/2022 |
| CN | 114318764 | A | 4/2022 |
| CN | 115404669 | A | 11/2022 |
| DE | 102016112551 | A1 | 1/2018 |
| WO | WO2011029766 | A1 | 3/2011 |

* cited by examiner

*Primary Examiner* — Jason Y Ko
(74) *Attorney, Agent, or Firm* — Dority & Manning, P.A.

(57) ABSTRACT

A method for operating a washing machine may include a step of receiving an input indicative of a first wash cycle command. The method may also include a step of selecting an active tank of two or more tanks based on the first wash cycle command. The method may further include a step of supplying a dose of additive to the tub from the active tank.

19 Claims, 7 Drawing Sheets

SYSTEMS AND METHODS FOR DISPENSING AN ADDITIVE FOR A WASHING MACHINE APPLIANCE

FIELD OF THE DISCLOSURE

The present subject matter relates generally to systems and methods for dispensing additives, such as in a washing machine appliance.

BACKGROUND OF THE DISCLOSURE

Washing machine appliances generally include a drum or basket rotatably mounted within a tub of a cabinet. The basket defines a wash chamber for receiving articles for washing. During operation, wash fluid is directed into the tub and onto articles within the wash chamber. The wash fluid may be a mixture of water and one or more additives, e.g., liquid detergent, powder detergent, bleach, softener, etc. Some washing machine appliances include bulk additive storage systems to dispense or direct the wash fluid into the tub. For example, during a wash cycle, additives may be mixed with water in the bulk additive storage system to form a wash fluid.

Bulk additive storage systems of certain washing machine appliances can include two or more bulk tanks or reservoirs. Each bulk tank can be configured to hold a large amount of one or more additives. Typically, each of the two or more tanks are configured to hold and dispense different additives. For example, one tank can hold and dispense liquid detergent and another tank can hold and dispense fabric softener. However, in some instances, a user may wish to use only one additive during wash cycles. For example, a user may wish to only use liquid detergent during wash cycles. In such instances, one of the two tanks can become idle and may not be utilized.

Accordingly, there is a need to maximize the utilization of the available bulk tank space based on a user's wash cycle needs. Specifically, a washing machine appliance that addresses one or more of the challenges noted above would be useful.

BRIEF DESCRIPTION OF THE DISCLOSURE

Aspects and advantages of the invention will be set forth in part in the following description, or may be obvious from the description, or may be learned through practice of the invention.

In one exemplary aspect of the present disclosure, a method for operating a washing machine is provided. The washing machine appliance may include a cabinet. The washing machine appliance may also include a basket rotatably provided within the tub. The washing machine appliance may further include a bulk additive storage system. The bulk additive storage system may include two or more tanks. The method may include a step of receiving an input indicative of a first wash cycle command. The method may also include a step of selecting an active tank of the two or more tanks based on the first wash cycle command. The method may further include a step of supplying a dose of additive to the tub from the active tank.

In another exemplary aspect of the present disclosure a washing machine appliance is provided. The washing machine appliance may include a cabinet. The washing machine appliance may also include a tub provided within the cabinet. The washing machine appliance may further include a basket rotatably provided within the tub and configured to hold a load of articles. The washing machine appliance may further include a bulk additive storage system provided in the cabinet. The bulk additive storage system may include two or more tanks. The washing machine appliance may also include a controller operable for: receiving an input indicative of a first wash cycle command; selecting an active tank of the two or more tanks based on the first wash cycle command; and supplying a dose of additive to the tub from the active tank.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
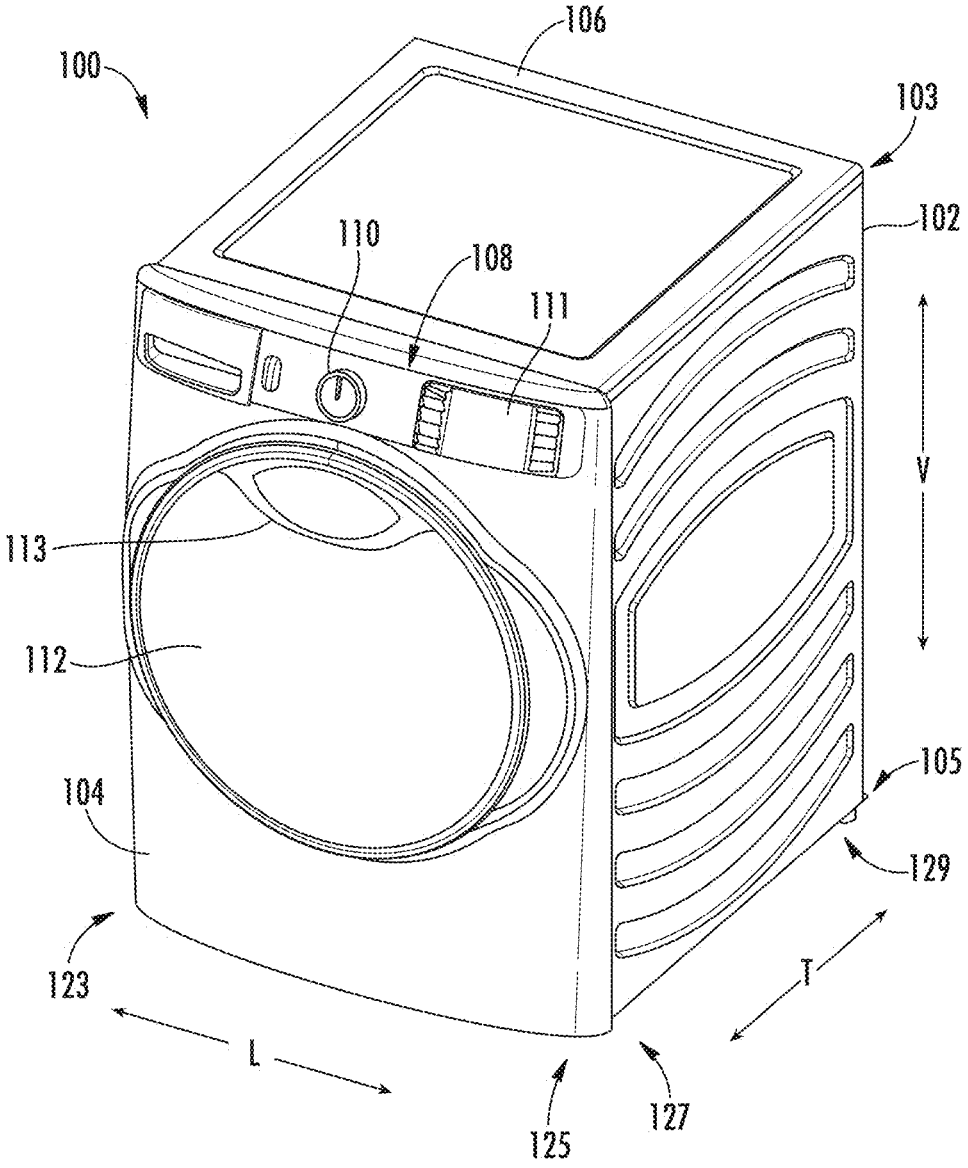
FIG. 1 provides a front, perspective view of a washing machine appliance according to one or more exemplary embodiments of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first" and "second" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). The term "at least one of" in the context of, e.g., "at least one of A, B, and C" refers to only A, only B, only C, or any combination of A, B, and C. In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a ten percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

The terms "wash fluid" and the like may be used herein to generally refer to a liquid used for washing or rinsing clothing or other articles. For example, the wash fluid is typically made up of water that may include other additives such as detergent, fabric softener, bleach, or other suitable treatments (including combinations thereof).

As used herein, the terms "clothing," "articles," and the like may include but need not be limited to fabrics, textiles, garments, linens, papers, or other items which may be cleaned, dried, or otherwise treated in a laundry appliance. Furthermore, the terms "load" or "laundry load" refers to the combination of clothing that may be washed together in a washing machine or dried together in a dryer appliance and may include a mixture of different or similar articles of clothing of different or similar types and kinds of fabrics, textiles, garments and linens within a particular laundering process.

Figure 2:
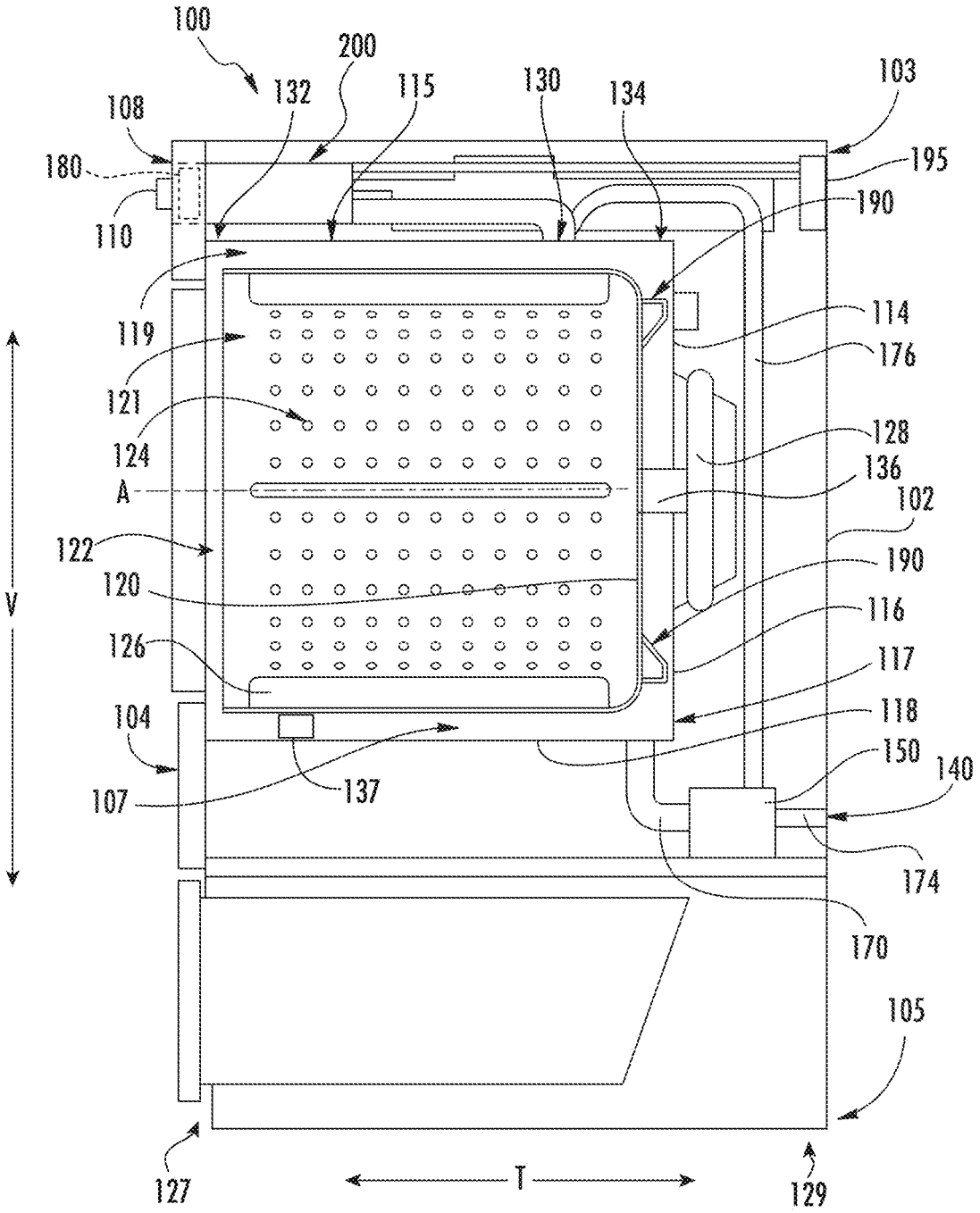
FIG. 2 provides a side, cross-sectional view of the exemplary washing machine appliance of FIG. 1.

FIGS. 1 and 2 provide various views of an exemplary washing machine appliance 100 according to one exemplary embodiment of the present disclosure. In particular, FIG. 1 provides a front, perspective view of horizontal axis washing machine appliance 100 and FIG. 2 provides a side, section view of washing machine appliance 100. As shown in FIG. 1, washing machine appliance 100 includes a cabinet 102 that extends between a top 103 and a bottom 105, e.g., along a vertical direction V. Cabinet 102 also extends between a first side 123 and a second side 125, e.g., along a lateral direction L, and between a front 127 and a rear 129, e.g., along a transverse direction T. The vertical direction V, the lateral direction L, and transverse directions T defined by washing machine appliance 100 are mutually perpendicular and together define an orthogonal direction system.

Cabinet 102 includes a front panel 104. A door 112 may be mounted to front panel 104. The door 112 may be rotatable between an open position (not shown) and a closed position (e.g., FIGS. 1 and 2). In the open position access to a wash drum or basket 120 (e.g., FIG. 2) located within the cabinet 102 may be facilitated. In the closed position access to the basket 120 may be hindered or restricted. A user may pull on a handle 113 in order to selectively adjust door 112 between the open position and the closed position. Cabinet 102 may also include a top panel 106 positioned at top 103 of cabinet 102.

A control panel 108 including a plurality of input selectors 110 may be coupled to front panel 104. Control panel 108 and input selectors 110 collectively form a user interface input for operator selection of machine cycles and features. For example, in some embodiments, control panel 108 includes a display 111 (e.g., FIG. 1) configured to present or indicate selected features, a countdown timer, or other items of interest to machine users.

As shown in FIG. 2, a tub 114 defines a wash fluid compartment 119 configured for receipt of a washing fluid. Thus, tub 114 is configured for containing washing fluid, e.g., during operation of washing machine appliance 100. Washing fluid disposed within tub 114 may include, for example, at least one of water, fabric softener, bleach, and detergent. Tub 114 includes a back wall 116 and a sidewall 118 and extends between a top 115 and a bottom 117, e.g., along the vertical direction V. Further, tub 114 extends between a front 132 and a rear 134, e.g., along the transverse direction T.

Basket 120 is rotatably mounted within tub 114 in a spaced apart relationship from tub sidewall 118 and tub back wall 116. One or more bearing assemblies may be placed between basket 120 and tub 114 and may allow for rotational movement of basket 120 relative to tub 114. Basket 120 defines a wash chamber 121 and an opening 122. Opening 122 of basket 120 permits access to wash chamber 121 of basket 120, e.g., in order to load articles into basket 120 and remove articles from basket 120. Basket 120 also defines a plurality of perforations 124 to facilitate fluid communication between an interior of basket 120 and tub 114. A sump 107 is defined by tub 114 and is configured for receipt of wash fluid during operation of appliance 100. For example, during operation of appliance 100, wash fluid may be urged by gravity from basket 120 to sump 107 through plurality of perforations 124.

A spout 130 is configured for directing a flow of fluid into tub 114. Spout 130 may be in fluid communication with a water supply (not shown) in order to direct fluid (e.g., clean water) into tub 114. A pump assembly 150 (shown schematically in FIG. 2) is located beneath tub 114 for draining tub 114 of fluid. Pump assembly 150 is in fluid communication with sump 107 of tub 114 via a conduit 170. Thus, conduit 170 directs fluid from tub 114 to pump assembly 150. Pump assembly 150 is also in fluid communication with a drain 140 via piping 174. Pump assembly 150 can urge fluid disposed in sump 107 to drain 140 during operation of appliance 100 in order to remove fluid from tub 114. Fluid received by drain 140 from pump assembly 150 is directed out of appliance 100, e.g., to a sewer or septic system.

In addition, pump assembly 150 is configured for recirculating washing fluid within tub 114. Thus, pump assembly 150 is configured for urging fluid from sump 107, e.g., to spout 130. For example, pump assembly 150 may urge washing fluid in sump 107 to spout 130 via hose 176 during operation of appliance 100 in order to assist in cleaning articles disposed in basket 120. It should be understood that conduit 170, piping 174, and hose 176 may be constructed of any suitable mechanism for directing fluid, e.g., a pipe, duct, conduit, hose, or tube, and are not limited to any particular type of mechanism.

A motor 128 is in mechanical communication with basket 120 in order to selectively rotate basket 120, e.g., during an agitation or a rinse cycle of washing machine appliance 100 as described below. In particular, a shaft 136 mechanically couples motor 128 with basket 120 and drivingly rotates basket 120 about a shaft or central axis A, e.g., during a spin cycle. Ribs 126 may extend from basket 120 into wash chamber 121. Ribs 126 may assist agitation of articles disposed within wash chamber 121 during operation of washing machine appliance 100. For example, ribs 126 may lift articles disposed in basket 120 during rotation of basket 120.

Also shown in FIG. 2 is a balancing apparatus 190. Balancing apparatus 190 can include a balancing ring, for example. The balancing ring can have an annular cavity in which a balancing material is free to rotate and move about. For example, the balancing material can be a fluid such as water or can be balancing balls. The balancing ring can include one or more interior baffles. Although a single balancing ring or apparatus 190 is shown in FIG. 2, any number of such rings or apparatuses can be included in washing machine appliance 100 and can be placed according to any known or desirable configuration. For example, two balancing rings can be respectively placed at the front and back of basket 120.

As further shown in FIG. 2, washing machine appliance 100 includes a detergent dispenser 200. Detergent dispenser 200 may include features for receiving various wash treatment additives (e.g., fluid detergent, powder detergent, fabric softener, bleach, powder or any other suitable liquid) and dispensing or directing them to wash fluid compartment 119 of tub 114 during operation of washing machine appliance 100. Detergent dispenser 200 will be described in further detail herein.

Operation of washing machine appliance 100 is controlled by a processing device or controller 180 that is operatively coupled to control panel 108 for user manipulation to select washing cycles and features. In response to user manipulation of control panel 108, controller 180 operates the various components of washing machine appliance 100 to execute selected machine cycles and features, which will be described in further detail herein.

Controller 180 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 180 may be constructed without using a microprocessor, e.g., using a combination of discrete analog or digital logic circuitry (such as switches, amplifiers, integrators, comparators, flip-flops, gates, and the like) to perform control functionality instead of relying upon software. Control panel 108 and other components of washing machine appliance 100 may be in communication with controller 180 via one or more signal lines or shared communication busses.

In some embodiments, the washing machine appliance 100 includes a load-size sensor 137 in operative communication with the controller 180. The load-size sensor 137 may be utilized to sense a load size, e.g., the size of a load of articles held within the basket 120 of the washing machine appliance 100. The load-size sensor 137 may be any suitable sensor that is configured to sense load size. For example, the load-size sensor 137 may be a weight sensor, a pressure sensor, a water level sensor, or an infrared sensor. As illustrated, in FIG. 2, the load-size sensor 137 may be positioned at or proximate to the bottom of the basket 120. For example, the load-size sensor 137 may be positioned within the tub 114 at the bottom of the basket 120.

In an illustrative example of operation of washing machine appliance 100, articles are loaded into basket 120, and a washing operation is initiated through operator manipulation of input selectors 110. Tub 114 may be filled with water and one or more wash treatment additives from detergent dispenser 200 to form a wash fluid. One or more valves of a water inlet valve 195 can be actuated by controller 180 to provide for filling tub 114 to the appropriate level for the amount (or number) of articles being washed. Water inlet valve 195 is in fluid communication with a water source, such as e.g., a hot water heater or a municipal water line. Once tub 114 is properly filled with wash fluid, the contents of basket 120 may be agitated with ribs 126 for cleansing of articles in basket 120.

After the agitation phase (e.g., first agitation phase, second agitation phase, etc.) of the wash cycle is completed, tub 114 may be drained. The articles may then be rinsed by again adding wash fluid to tub 114 depending on the particulars of the cleaning cycle selected by a user, and ribs 126 may again provide agitation within wash chamber 121. One or more spin cycles may also be used. In particular, a spin cycle may be applied after the wash cycle or after the rinse cycle in order to wring wash fluid from the articles being washed. During the spin cycle, basket 120 is rotated at relatively high speeds.

While described in the context of a specific embodiment of horizontal axis washing machine appliance 100, it will be understood that horizontal axis washing machine appliance 100 is provided by way of example only. Other washing machine appliances having different configurations, different appearances, or different features may also be utilized with the present subject matter as well, including, for example, vertical axis washing machine appliances. Thus, the teachings of the present disclosure are not limited to use with washing machine appliance 100.

Figure 3:
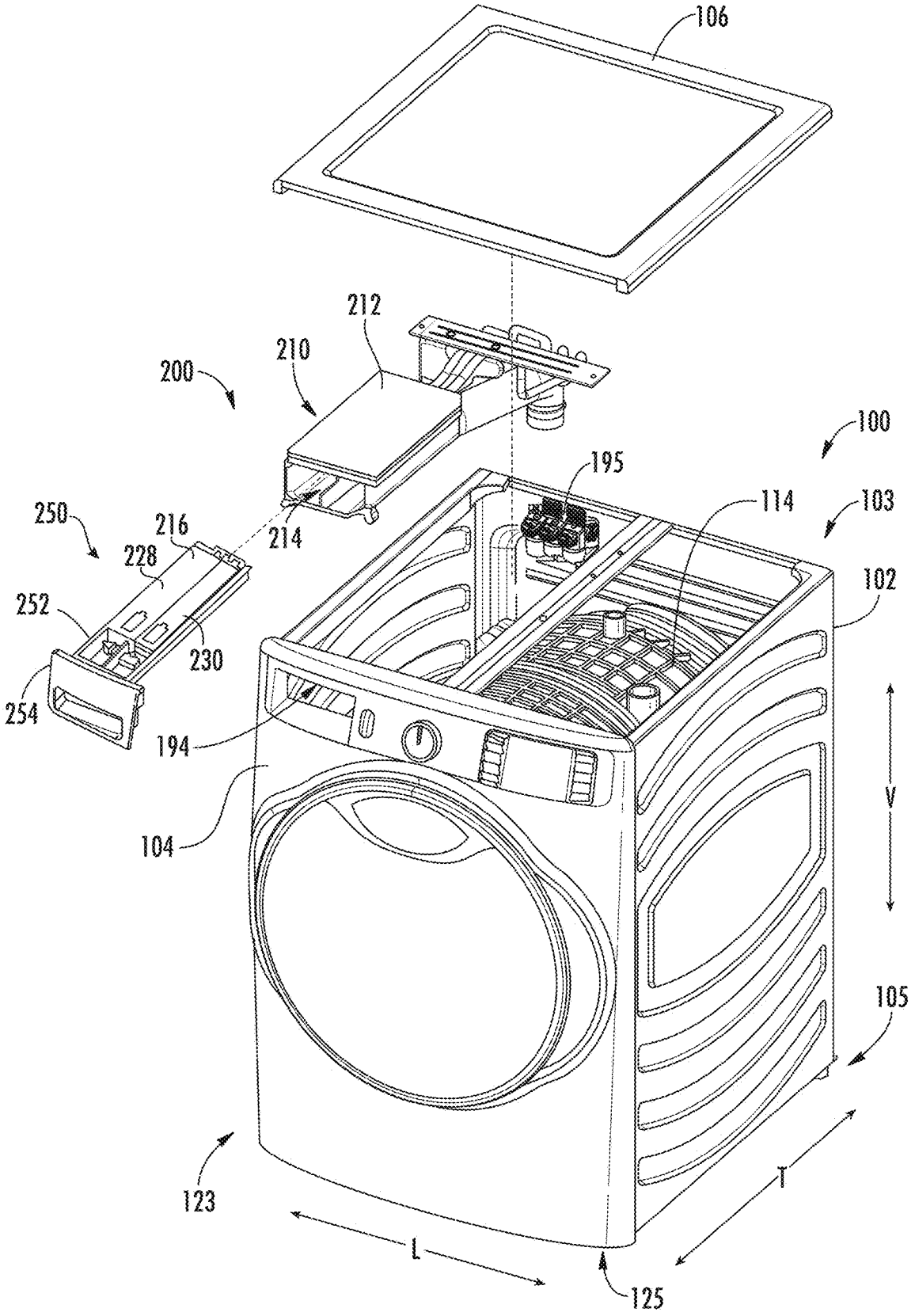
FIG. 3 provides a partial exploded perspective view of a detergent dispenser of the washing machine appliance of FIG. 1

FIG. 3 provides a view of a detergent dispenser 200 of the washing machine appliance of FIGS. 1 and 2 according to an exemplary embodiment of the present disclosure. More specifically, FIG. 3 provides a partial exploded perspective view of detergent dispenser 200. As shown in FIG. 3, detergent dispenser 200 may include a diffuser assembly 210 and drawer assembly 250. Diffuser assembly 210 may have a manifold 212 that has a generally rectangular shape. Manifold 212 may extend between a front and a back, e.g., along the transverse direction T, between a top and a bottom, e.g., along the vertical direction V, and between a first side and a second side, e.g., along the lateral direction L. Further, manifold 212 may define an interior volume 214. Interior volume 214 of manifold 212 may be sized to receive at least a portion of drawer assembly 250. Drawer assembly 250 may be slidably received within manifold 212 (e.g., within interior volume 214 of manifold 212) between a withdrawn position and a retracted position. That is, drawer assembly 250 may be movable between the withdrawn position and the retracted position, e.g., along the transverse direction T. In the withdrawn position, drawer assembly 250 may be at least partially withdrawn from manifold 212 so that a user may readily access one or more additive compartments or tanks of drawer assembly 250, e.g., to fill one of the compartments with an additive. In the retracted position, drawer assembly 250 may be received within manifold 212, e.g., so that one or more of the additive compartments of drawer assembly 250 are in fluid communication with water inlet valve 195 and tub 114 during operation of washing machine appliance 100. Generally, drawer assembly 250 may include a drawer 252 and a handle 254. A user may grasp handle 254 of drawer assembly 250 to slide or move drawer assembly 250 between the withdrawn and retracted positions. An opening 194 defined by front panel 104 may allow drawer assembly 250 to slide or move between the withdrawn and retracted positions.

In some embodiments, the detergent dispenser 200 includes a bulk additive storage system 216. The bulk additive storage system 216 may store or hold a large amount of an additive, e.g., detergent, for use in washing machine appliance 100 such as during a washing cycle. The bulk additive storage system 216 may be in fluid communication with drawer 252 and tub 114. Bulk additive storage system 216 may include a first tank 228 and second tank 230. The first tank 228 and the second tank 230 may each store (e.g., distinctly, or separately) a large amount of additive, e.g., detergent. In this regard, the user may supply a large amount of the additive, e.g., liquid detergent, to drawer 252 which in turn is stored in the first tank 228 or the second tank 230. The amount of additive stored in the first tank 228 and the second tank 230, respectively, may be greater than an amount of additive that may be utilized for an individual washing cycle. In some embodiments, the bulk additive storage system 216 stores multiple washing cycle's worth of an additive, e.g., liquid detergent. Accordingly, the additive may be supplied to tub 114 from bulk additive storage system 216 without requiring a user to supply the additive to drawer 252 before each washing cycle.

The bulk additive storage system 216 may be in operative communication with a dosing mechanism (not depicted) to selectively supply a dose of additive contained within the first tank 228 or the second tank 230. Dosing mechanisms may be well known in the art and accordingly are described briefly herein. For example, the dosing mechanism may be a peristaltic pump, a piston pump, or any other suitable pump. The dose of additive may be supplied from the first tank 228 or the second tank 230 in any suitable manner. For example, in one exemplary embodiment, the first tank 228 and the second tank 230 may each include a valve (not depicted). Each valve may be any suitable type of valve that is capable of interfacing with or connecting to the dosing mechanism. For example, each valve may be a plunger type valve. The dosing mechanism may be in operative communication with the controller 180 and may be configured to selectively permit a desired amount of additive to flow from first tank 228 or the second tank 230, respectively, to a dispensing area within the dispenser manifold 212.

It should be appreciated that the first tank 228 and the second tank 230 of the bulk additive storage system 216 are provided by way of example only. In additional or alternative exemplary embodiments of the present subject matter, the bulk additive storage system 216 may include two or more tanks. For example, the bulk additive storage system 216 may include three or more tanks, such as four tanks.

Figure 4:
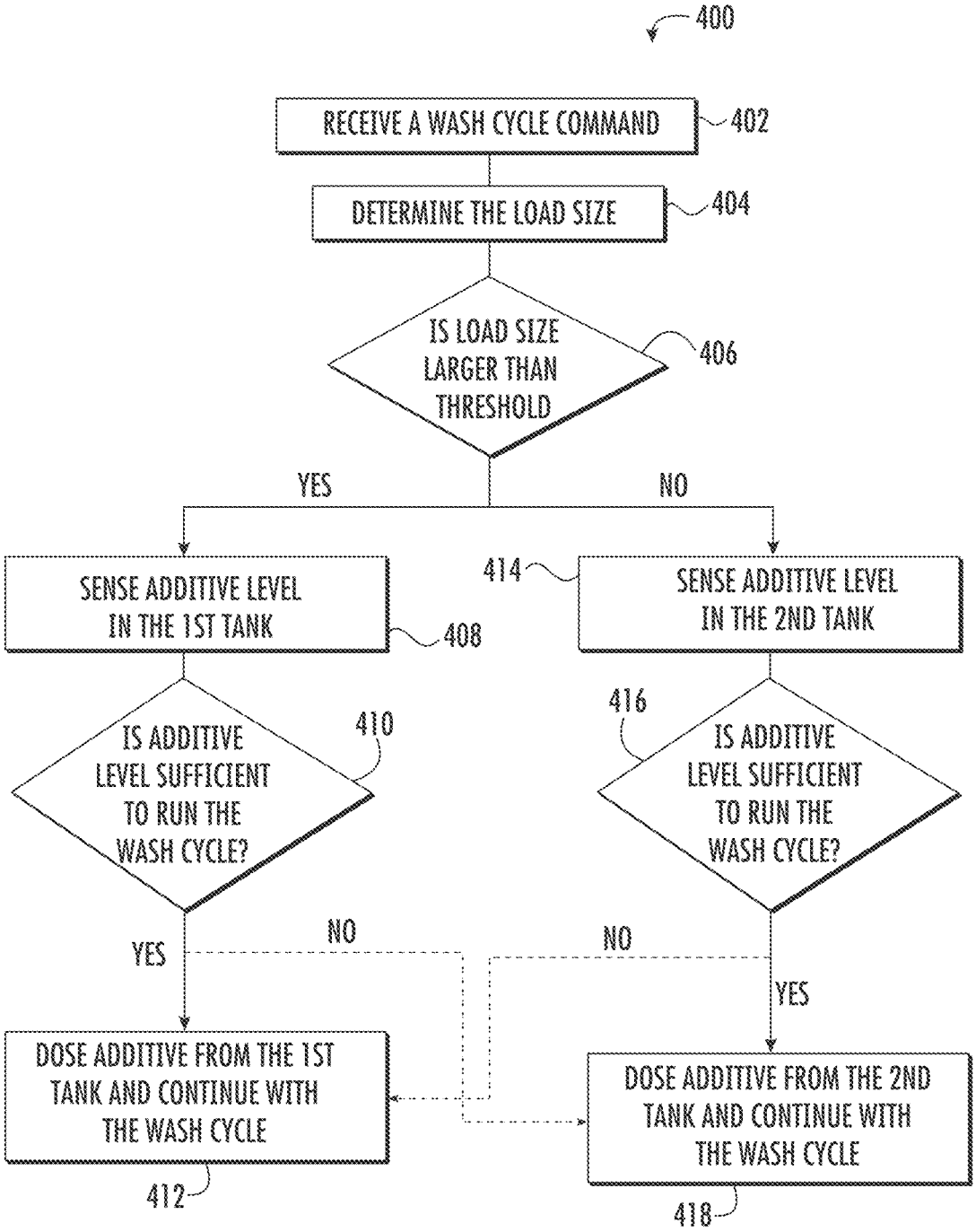
FIG. 4 provides a flow diagram of an algorithm that may be used to supply a dose of additive from a bulk additive storage system of a washing machine appliance according to one or more exemplary embodiments of the present subject matter.

Referring now to FIG. 4, a flow diagram of an algorithm 400 that may be used to operate a washing machine appliance, such as the washing machine appliance 100, according to one or more exemplary embodiments of the present subject matter is provided. The algorithm 400 described herein, and illustrated in FIG. 4, may be implemented on any suitable washing machine appliance, for example, to operate the washing machine appliance. For instance, a controller of the washing machine appliance, such as the controller 180 of the washing machine appliance 100, may be operable for implementing the functions of the algorithm 400 such as to operate the washing machine appliance.

In general, the algorithm 400 may be utilized during a wash cycle to supply a dose of additive from an active tank of the bulk additive storage system to a tub, e.g., the tub 114, of a washing machine appliance. As used herein the "active tank" may refer to a selectable or variable designation of a discrete tank of the bulk additive storage system, such as might be selected from the first tank 228 or the second tank 230. The active tank may be utilized during the wash cycle to supply wash fluid, e.g., a mixture of water and additive, to the tub. As the bulk additive storage system may include two or more tanks, the active tank may be a discrete tank selected from the two or more tanks. As will be detailed herein, the selection of the active tank may be based on the load size of the load of articles held within the basket, e.g., the basket 120, or an additive level of the two or more tanks.

For example, as will be described in greater detail below, the algorithm 400 may advantageously supply a dose of additive from the first tank when the basket contains a larger load of articles, e.g., a load of articles that is greater than or equal to a load size threshold. However, if the first tank does not contain a sufficient amount of additive, the algorithm 400 may advantageously supply the dose of additive from the second tank or may advantageously supplement the first tank with additive from the second tank, e.g., such that the amount of additive required is met.

Further, the algorithm 400 may also advantageously supply a dose of additive from the second tank when the basket contains a smaller load of articles, e.g., a load of articles held within the basket than is less than the load size threshold. However, if the second tank does not contain a sufficient amount of additive, the algorithm 400 may advantageously supply the dose of additive from the first tank or may advantageously supplement the second tank with additive from the first tank, e.g., such that the amount of additive required is met.

Specifically, the algorithm 400 includes a process function 402 of receiving a wash cycle command. More particularly, the process function 402 may include receiving an input indicative of the wash cycle command. For instance, the input may be received in response to user manipulation of a variety of controls of the washing machine appliance, for example, user manipulations of the plurality of input selectors 110 of the control panel 108. The wash cycle command, or more particularly, the inputs received indicative of the wash cycle command, may include desired wash cycle options or wash cycle setting that may be performed by the washing machine appliance.

For example, a user may select wash cycle options or wash cycle setting to be performed by the washing machine appliance. The wash cycle options may include, for example, a Delicate cycle, a Normal cycle, a Cotton cycle, a White or Colors cycle, a Towels cycle, etc. (e.g., as would be understood). It should be noted that the washing cycle is not limited to the list above and may include any suitable wash cycle option. The wash cycle settings may include, for example, an auto soak option, a turbidity sensor feedback option, a high spin option, a multiple rinse option, etc. It should be noted that the washing option is not limited to the list above and may include any suitable option.

In some embodiments, following the execution of process function 402, the algorithm 400 may include a process function 404 of determining a load size. In some embodiments, the process function 404 includes receiving an input indicative of the load size of the load of articles. For instance, the input may be received in response to user manipulation of a variety of controls of the washing machine appliance, for example, user manipulations of the plurality of input selectors 110 of the control panel 108.

Additionally or alternatively, in some embodiments, the process function 404 includes sensing a load size of a load of articles held within a basket, e.g., basket 120, of the washing machine appliance. The load size of the load of articles held within the basket may be determined, and more particularly, may be sensed, via the utilization of a load-size sensor, e.g., the load-size sensor 137 in operative communication with a controller, e.g., controller 180, or any suitable method.

For example, the load-size sensor can include or be provided as a weight sensor, e.g., strain gauges, piezoelectric sensors, etc., in operative communication with a controller of the washing machine appliance. The weight sensor may be positioned at or proximate to a bottom of the basket. The weight sensor may be configured to measure the load size of a load of articles based on the weight of the basket. For example, the weight sensor may be configured to sense and collect weight measurements of the basket prior to, during, or after, articles have been added to the basket. In this regard, the weight measurements may be utilized to determine a load size of the load of articles within the basket.

As another example, the load-size sensor can include or be provided as a water level sensor, e.g., float switches, pressure sensors, ultrasonic sensors, etc., in operative communicating with the controller of the washing machine appliance. The water level sensor may be configured to monitor and collect water level data of the water level within the basket during the initial stages of a wash cycle. The water level sensor may compare the collected water level data to historical water level data to determine the load size of the load of articles within the basket.

Further, in some embodiments, the algorithm 400 may include a decision function 406, wherein it may be determined if the load size, e.g., as determined at process function 404, is larger than a load size threshold. In general, the load size threshold may be utilized to determine if the load size of the load of articles is a larger load size or a smaller load size. In some embodiments, the algorithm 400 may primarily utilize a first discrete tank, e.g., the first tank 228, during wash cycles that contain larger load sizes. Additionally or alternatively, in some embodiments, the algorithm 400 may primarily utilize a second discrete tank, e.g., the second tank 230, during wash cycles that contain smaller load sizes.

The load size threshold may be based on the wash cycle command, and more particularly, the wash cycle options or wash cycle settings, that may have been received at process function 402. For example, wash cycle options or wash cycle settings may correspond to predetermined load size thresholds. In some instances, it may be determined at the decision function 406 that the load size of the load of articles held within the basket is larger than the load size threshold. For example, there may be a larger amount of articles held within the basket. In such instances, the algorithm 400 may execute a process function 408 of sensing an additive level of a first tank, e.g., the first tank 228, of a bulk additive storage system. The process function 408 may be performed by any suitable sensor that may be capable of sensing a level of an additive within the first tank of the bulk additive storage system. For example, the process function 408 may be performed by a weight sensor, an ultrasonic sensor, a float switch, etc.

In some embodiments, after the execution of the process function 408, the algorithm 400 may execute a decision function 410, wherein it may be determined if the additive level, e.g., as sensed at process function 408, of the first tank is sufficient to run the wash cycle. In other words, the decision function 410 may determine if there is enough additive within the first tank to complete a wash cycle with the larger amount of articles held within the basket. For example, the decision function 410 may include comparing the sensed additive level to a predetermined additive threshold. The predetermined additive threshold may be based on the load size determined, e.g., at process function 404. For example, the predetermined additive threshold may correspond to an amount of additive needed to wash the larger load of articles held within the basket. Additionally or alternatively, the predetermined additive threshold could be a volume of additive that is based on the wash cycle options or wash cycles settings to be performed by the washing machine appliance, e.g., as received at process function 402. For instance, each wash cycle option or wash cycle setting may need a volume of additive that is predetermined or programmed into the controller of the washing machine appliance. In this regard, an amount of additive needed to adequately wash the load of articles may be provided.

In some instances, it may be determined at decision function 410 that the additive level of the first tank is sufficient to run the wash cycle. For example, the sensed additive level may be greater than or equal to the predetermined additive threshold. In such instances, the algorithm 400 may execute a process function 412 of supplying a dose of additive, e.g., the predetermined additive threshold, held within the first tank to a tub, e.g., the tub 114, of the washing machine appliance and continuing the wash cycle based on the received wash cycle commands.

Alternatively, in some instances, it may be determined at decision function 410 that the additive level of the first tank is not sufficient to run the wash cycle. For example, the sensed additive level may be less than the predetermined additive threshold. In such instances, the algorithm 400 may execute a process function 418 of supplying a dose of an additive held within a second tank, e.g., the second tank 230, of the washing machine appliance and continuing the wash cycle based on the received wash cycle commands.

In some instances, it may be determined at the decision function 406 that the load size of the load of articles held within the basket is not larger, e.g., is smaller, than the load size threshold. For example, there may be a smaller amount of articles held within the basket. In such instances, the algorithm 400 may execute a process function 414 of sensing an additive level of a second tank, e.g., the second tank 230 of a bulk additive storage system. The process function 414 may be performed by any suitable sensor that may be capable of sensing a level of an additive within the first tank of the bulk additive storage system. For example, the process function 408 may be performed by a weight sensor, an ultrasonic sensor, a float switch, etc., In some embodiments, after the execution of the process function 414, the algorithm 400 may execute a decision function 416, wherein it may be determined if the additive level, e.g., as sensed at process function 414, of the second tank is sufficient to run the wash cycle. In other words, the decision function 416 may determine if there is enough additive within the second tank to complete a wash cycle with the smaller amount of articles held within the basket. For example, the decision function 416 may include comparing the sensed additive level to a predetermined additive threshold. The predetermined additive threshold may be based on the load size determined, e.g., at process function 404. For example, the predetermined additive threshold may correspond to an amount of additive needed to wash the smaller load of articles held within the basket. Additionally or alternatively, the predetermined additive threshold could be a volume of additive that is based on the wash cycle options or wash cycle settings to be performed by the washing machine appliance, e.g., as received at process function 402. For instance, each wash cycle option or wash cycle setting may need a volume of additive that is predetermined or programmed into the controller of the washing machine appliance. In this regard, an amount of additive needed to adequately wash the load of articles may be provided.

In some instances, it may be determined at decision function 416 that the additive level of the second tank is sufficient to run the wash cycle. For example, the sensed additive level may be greater than or equal to the predetermined additive threshold. In such instances, the algorithm 400 may execute the process function 418 of supplying a dose of additive held within the second tank to a tub, e.g., the tub 114, and continuing the wash cycle based on the received wash cycle commands.

Alternatively, in some instances, it may be determined at decision function 416 that the additive level of the second tank is not sufficient to run the wash cycle. For example, the sensed additive level may be less than the predetermined additive threshold. In such instances, the algorithm 400 may execute the process function 412 of supplying a dose of an additive held within the first tank, e.g., the first tank 228, of the washing machine appliance and continuing the wash cycle based on the received wash cycle commands.

Figure 5:
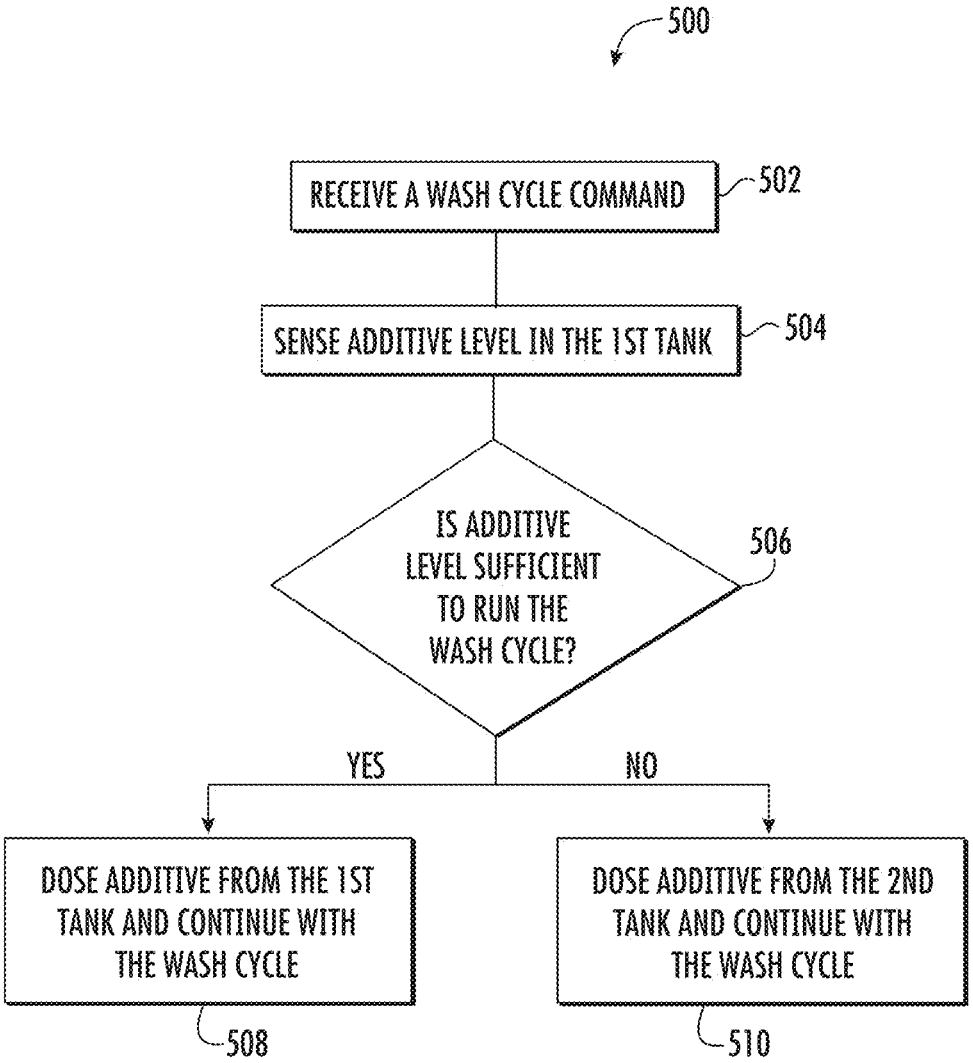
FIG. 5 provides a flow diagram of another algorithm that may be used to supply a dose of additive from a bulk additive storage system of a washing machine appliance according to one or more exemplary embodiments of the present subject matter.

Referring now to FIG. 5, a flow diagram of an algorithm 500 that may be used to operate a washing machine appliance, such as the washing machine appliance 100, according to one or more exemplary embodiments of the present subject matter is provided. The algorithm 500 described herein, and illustrated in FIG. 500, may be implemented on any suitable washing machine appliance, for example, to operate the washing machine appliance. For instance, a controller of the washing machine appliance, such as the controller 180 of the washing machine appliance 100, may be operable for implementing the functions of the algorithm 500 such as to operate the washing machine appliance.

In general, the algorithm 500 may determine when the additive level of a tank that is selected as the active tank is low. For example, the active tank may be a first tank, e.g., the first tank 228. The first tank may be the active tank until it is sensed that the additive level of the first tank is less than the predetermined additive threshold needed for a wash cycle. In such instances, the algorithm 500 may switch the tank that is selected as the active tank. For example, the algorithm 500 may then select a second tank, e.g., the second tank 230, as the active tank. A dose of additive may then be supplied from the second tank, e.g., as it is now the active tank, for subsequent wash cycles.

Specifically, the algorithm 500 includes a process function 502 of receiving a wash cycle command. The process function 502 may include receiving an input indicative of the wash cycle command. For instance, the input may be received in response to user manipulation of a variety of controls of the washing machine appliance, for example, user manipulations of the plurality of input selectors 110 of the control panel 108. The wash cycle command, or more particularly, the inputs received indicative of the wash cycle command, may include desired wash cycle options or wash cycle setting that may be performed by the washing machine appliance.

For example, a user may select wash cycle options or wash cycle setting to be performed by the washing machine appliance. The wash cycle options may include, for example, a Delicate cycle, a Normal cycle, a Cotton cycle, a White or Colors cycle, a Towels cycle, etc. (e.g., as would be understood). It should be noted that the washing cycle is not limited to the list above and may include any suitable wash cycle option. The wash cycle settings may include, for example, an auto soak option, a turbidity sensor feedback option, a high spin option, a multiple rinse option, etc. It should be noted that the washing option is not limited to the list above and may include any suitable option.

Additionally, in some embodiments, following the execution of process function 502, the algorithm 500 may include a process function 504 of sensing an additive level of an active tank, e.g., a first tank such as first tank 228, of the washing machine appliance. The process function 504 may be performed by any suitable sensor that may be capable of sensing a level of an additive within the first tank of the bulk additive storage system. For example, the process function 504 may be performed by a weight sensor, an ultrasonic sensor, a float switch, etc.

In some embodiments, after the execution of the process function 504, the algorithm 500 may execute a decision function 506, wherein it may be determined if the additive level of the active tank, e.g., the first tank, is sufficient to run the wash cycle. In other words, the decision function 506 may determine if there is enough additive within the active tank, e.g., the first tank, to complete a wash cycle, wherein the wash cycle may be based on the wash cycle options and wash cycle settings received at process function 502. For example, the decision function 506 may include comparing the sensed additive level to a predetermined additive threshold. The predetermined additive threshold could be a volume of additive that is based on the wash cycle options or wash cycles settings to be performed by the washing machine appliance, e.g., as received at process function 402. For instance, each wash cycle option or wash cycle setting may need a volume of additive that is predetermined or programmed into the controller of the washing machine appliance. In this regard, an amount of additive needed to adequately wash the load of articles may be provided.

In some instances, it may be determined at decision function 506 that the additive level of the first tank is sufficient to run the wash cycle. For example, the sensed additive level may be greater than or equal to the predetermined additive threshold. In such instances, the algorithm 500 may execute a process function 508 of supplying a dose of an additive, e.g., the predetermined additive threshold for the desired washing option or washing cycles to be performed by the washing machine appliance, held within the active tank, e.g., the first tank to a tub, e.g., the tub 114, of the washing machine appliance and continuing the wash cycle based on the received wash cycle commands.

Alternatively, in some instances, it may be determined at decision function 506 that the additive level of the first tank is not sufficient to run the wash cycle. For example, the sensed additive level may be less than the predetermined additive threshold. In such instances, the algorithm 500 may include selecting a separate and distinct tank, e.g., a second tank such as the second tank 230, as the active tank. Moreover, the algorithm 500 may execute a process function 510 of supplying a dose of additive held within the selected active tank, e.g., the second tank, to the tub of the washing machine appliance and continuing the wash cycle based on the received wash cycle commands.

Figure 6:
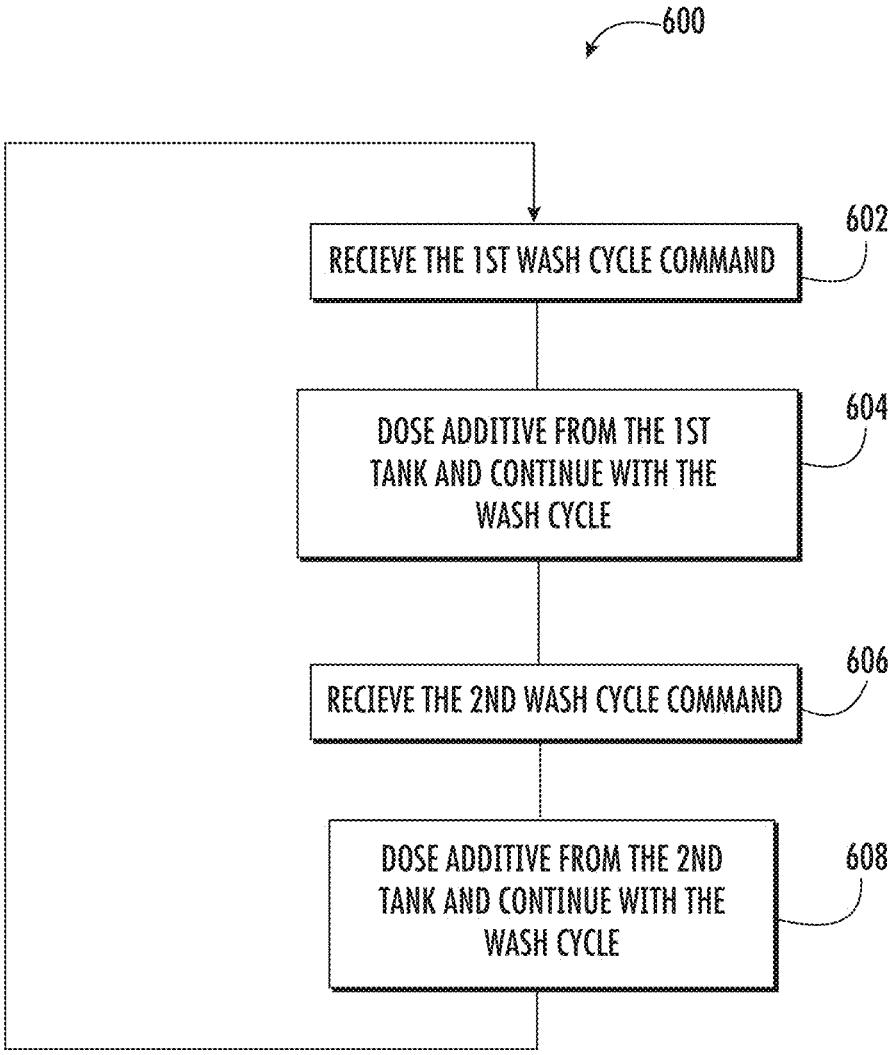
FIG. 6 provides a flow diagram of yet another algorithm that may be used to supply a dose of additive from a bulk additive storage system of a washing machine appliance according to one or more exemplary embodiments of the present subject matter.

Referring now to FIG. 6, a flow diagram of an algorithm 600 that may be used to operate a washing machine appliance, such as the washing machine appliance 100, according to one or more exemplary embodiments of the present subject matter is provided. The algorithm 600 described herein, and illustrated in FIG. 6, may be implemented on any suitable washing machine appliance, for example, to operate the washing machine appliance. For instance, a controller of the washing machine appliance, such as the controller 180 of the washing machine appliance 100, may be operable for implementing the functions of the algorithm 600 such as to operate the washing machine appliance.

In general, the algorithm 600 may alternate the usage of the two or more tanks of a bulk additive storage system. For example, the algorithm 600 may generally utilize one tank, e.g., a first tank such as the first tank 228, in a first wash cycle, and another distinct and separate tank, e.g., a second tank such as the second tank 230, in a second subsequent wash cycle.

For instance, the algorithm 600 may include a process function 602 of receiving a first wash cycle command. More particularly, the process function 602 may include receiving an input indicating of the first wash cycle command for a first wash cycle to be performed by the washing machine appliance. For instance, the input may be received in response to user manipulation of a variety of controls of the washing machine appliance, for example, user manipulations of the plurality of input selectors 110 of the control panel 108. The first wash cycle command, or more particularly, the inputs received indicative of the first wash cycle command, may include desired wash cycle options or wash cycle setting that may be performed by the washing machine appliance.

In some embodiments, the algorithm 600 may further include a process function 604 of supplying a dose of additive held within the first tank to a tub, e.g., the tub 114, during the first wash cycle. Further, the process function 604 may include continuing the first wash cycle based on the received first wash cycle commands.

Additionally, the algorithm 600 may include a process function 606 of receiving a second wash cycle command. More particularly, the process function 606 may include receiving an input indicative of the second wash cycle command for the second wash cycle to be performed by the washing machine appliance. The second wash cycle may be subsequent to the first wash cycle. For example, the second wash cycle may be the wash cycle that immediately follows the first wash cycle. For instance, the input may be received in response to user manipulation of a variety of controls of the washing machine appliance, for example, user manipulations of the plurality of input selectors 110 of the control panel 108. The second wash cycle command, or more particularly, the inputs received indicative of the second wash cycle command, may include desired wash cycle options or wash cycle setting that may be performed by the washing machine appliance.

In some embodiments, the algorithm 600 may further include a process function 608 of supplying a dose of additive held within the second tank to the tub during the second wash cycle. Further, the process function 608 may include continuing the second wash cycle based on the received second wash cycle commands.

Figure 7:
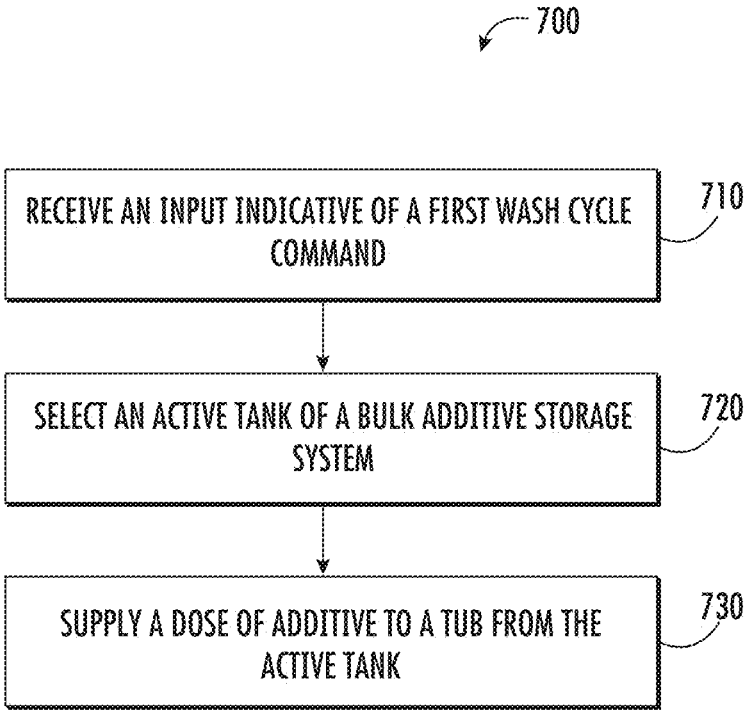
FIG. 7 provides a flow chart of an exemplary method of operating a washing machine appliance according to one or more exemplary embodiments of the present subject matter.

Referring now to FIG. 7, embodiments of the present subject matter may include one or more methods for operating a washing machine appliance, such as the exemplary washing machine appliance 100 described above, as well as other possible exemplary washing machine appliances. The exemplary methods according to the present subject matter may include a method 700, for example, as illustrated in FIG. 7. A controller of the washing machine appliance, such as the controller 180 of the exemplary washing machine 100, may be programmed to implement method 700, for example, the controller, such as controller 180, may be capable of and may be operable to perform any methods and associated method steps as disclosed herein.

In some embodiments, the method 700 includes a step 710 of receiving an input indicative of a first wash cycle command. The first wash cycle command may be a first set of desired wash cycle options or wash cycle settings to be performed by the washing machine appliance. For instance, the input may be received in response to user manipulation of a variety of controls of the washing machine appliance, for example, user manipulations of the plurality of input selectors 110 of the control panel 108.

For example, in one embodiment, a user may select wash cycle options or wash cycle settings to be performed by the washing machine appliance. The wash cycle options may include, for example, a Delicate cycle, a Normal cycle, a Cotton cycle, a White or Colors cycle, a Towels cycle, etc. It should be noted that the washing cycle is not limited to the list above and may include any suitable cycle. The wash cycle settings may include, for example, an auto soak option, a turbidity sensor feedback option, a high spin option, a multiple rinse option, etc. It should be noted that the washing option is not limited to the list above and may include any suitable option, as would be understood.

Additionally, in some embodiments, the method 700 includes a step 720 of selecting an active tank of a bulk additive storage system. As described in more detail above, e.g., with reference to the bulk additive storage system 216, the bulk additive storage system may include two or more tanks. Each tank of the two or more tanks may be configured to hold a volume of an additive, e.g., liquid detergent. As should be appreciated, in exemplary embodiments of the present subject matter, the two or more tanks may hold the same type of additive. For example, a first tank, e.g., the first tank 228, and a second tank, e.g., the second tank 230, may both hold the same additive, e.g., may both hold liquid detergent.

The step 720 may include a step of sensing an additive level of a first tank of the two or more tanks. The step of sensing the additive level of the first tank may be performed by any suitable sensor capable of sensing an additive level, e.g., a volume of the additive, within the first tank. For example, the step 720 may be performed by a weight sensor, an ultrasonic sensor, a float switch, etc. The step 720 may also include a step of comparing the sensed additive level of the first tank to a predetermined additive threshold. The predetermined additive threshold may be a volume of additive needed, e.g., required, for a wash cycle. The volume of additive needed may correspond to or be determined by the wash cycle options or the wash cycle settings of the wash cycle. In some instances, the predetermined additive threshold needed may be predetermined or programmed within the controller of the washing machine appliance. For instance, each wash cycle setting, or wash cycle option may correspond to a volume of additive needed for the wash cycle. In this regard, the predetermined additive threshold may be based, at least in part, on the wash cycle option or the wash cycle settings that may be selected by a user. In some embodiments, the predetermined additive threshold is based on the first wash cycle command. For example, the predetermined additive threshold may be based on, or determined by, the received input indicative of the first wash cycle command.

In some embodiments, based on the comparison of the additive level of the first tank to the predetermined additive threshold, it is determined that the additive level of the first tank is greater than or equal to the predetermined additive threshold. For instance, the sensed volume of additive held within the first tank, may be greater than or equal to the predetermined additive threshold. In such instances, the first tank may be selected as an active tank (e.g., to the exclusion of any other tank). As will be described in more detail below, a dose of additive held within the active tank may be supplied to a tub of the washing machine appliance.

Alternatively, in some embodiments, based on the comparison of the additive level of the first tank to the predetermined additive threshold, it is determined that the additive level of the first tank is less than the predetermined additive threshold. For instance, the sensed volume of additive held within the first tank may be less than the predetermined additive threshold, e.g., the required volume of additive. In such instances, a second tank, e.g., a tank that may be distinct and separate from the first tank, may be selected as the active tank (e.g., to the exclusion of the first tank or any other tank).

Additionally or alternatively, in some embodiments, the step 720 of selecting the active tank of the bulk additive storage system may include determining a load size of a load of articles held within a basket of the washing machine appliance. For instance, as described in more detail above, a load size of a load of articles held within a basket of the washing machine appliance may be determined, or sensed, utilizing any suitable sensor. For example, the load size of a load of articles held within a basket of the washing machine appliance may be determined via the utilization of a weight sensor or a water level sensor. Further, the step 720 may also include comparing the load size of the load of articles held within the basket to a load size threshold. The load size threshold may correspond to a predetermined load size based on the first wash cycle commands, e.g., the inputs indicative of the first wash cycle command.

In some embodiments, based on the comparison of the load size of the load of articles held within the basket to the load size threshold, it is determined that the load size of the load of articles held within the basket is greater than or equal to the load size threshold. In such instances, the step of selecting the active tank of the bulk additive storage system further includes sensing an additive level of a first tank of the two or more tanks, e.g., as described in more detail above. Additionally, in such instances, the step of selecting the active tank of the bulk additive storage system includes comparing the sensed additive level of the first tank to a predetermined additive threshold, e.g., as described in more detail above.

Based on the comparison of the sensed additive level of the first tank to the predetermined additive threshold, it may be determined that the sensed additive level of the first tank is greater than or equal to the predetermined additive threshold. In such embodiments, the first tank may be selected as the active tank. Alternatively, based on the comparison of the sensed additive level of the first tank to the predetermined additive threshold, it may be determined that the sensed additive level of the first tank is less than the predetermined additive threshold. In such embodiments, the second tank may be selected as the active tank.

Alternatively, based on the comparison of the load size of the load of articles held within the basket to the load size threshold, it may be determined that the load size of the load of articles held within the basket is less than the load size threshold. In such embodiments, the step of selecting the active tank of the bulk additive storage system further includes sensing an additive level of a second tank of the two or more tanks, e.g., as described in more detail above. Additionally, in such embodiments, the step of selecting the active tank of the bulk additive storage system may also include comparing the sensed additive level of the second tank to the predetermined additive threshold.

Based on the comparison of the sensed additive level of the second tank to the predetermined additive threshold, it may be determined that the sensed additive level of the second tank is greater than or equal to the predetermined additive threshold. In such instances, the second tank may be selected as the active tank. Alternatively, based on the comparison of the sensed additive level of the second tank to the predetermined additive threshold, it may be determined that the sensed additive level of the second tank is less than the predetermined additive threshold. In such instances the first tank may be selected as the active tank.

Additionally or alternatively, in some embodiments, the method 700 may be configured to alternate the active tank of the bulk additive storage system. For instance, the method 700 may be configured to utilize a first discrete tank, e.g., the first tank 228 during a first wash cycle. Further, the method 700 may be configured to utilize a second discrete tank, e.g., the second tank 230, during a second wash cycle, e.g., a wash cycle that is subsequent to the first wash cycle. In such embodiments, the step 720 of selecting an active tank of the bulk additive storage system may include selecting a first tank, e.g., the first tank 228, as the active tank of the bulk additive storage system. Further, the step 720 may include a step of receiving an input indicative of a second wash cycle command, e.g., a wash cycle command for the second wash cycle. In addition, the step 720 may include a step of selecting a second tank as the active tank of the bulk additive storage system. In this regard, during the second wash cycle, the active tank may be the second tank.

Further, the step 720 may include a step of supplying a dose of additive to the tub from the active tank. As described in more detail above, the active tank may be a distinct tank of the bulk additive storage system. In this regard, the dose of additive may be supplied to the tub of the washing machine appliance via the bulk additive storage system. In some embodiments, the dose of additive is supplied to the tub together with an amount of water, e.g., to form a wash fluid. In this regard, the step 720 of supplying a dose of additive to the tub from the active tank may include combining an amount of water with the dose of additive from the active tank to form a wash fluid. Further, the step 720 may include supplying the formed wash fluid to the tub of the washing machine appliance.

Embodiments of the present subject matter advantageously provide systems and methods for selectively dispensing additives from a bulk additive storage system. In exemplary embodiments of the present subject matter the bulk additive storage system can include two or more tanks which hold wash additives, for example, detergent, fabric softener, liquid sanitizer, etc. In many instances, the two or more tanks may be filled with the same wash additive, for instance, the two or more tanks may all be filled with liquid detergent.

In such instances, embodiments of the present subject matter may advantageously be capable of setting one of the tanks as an active tank, e.g., a tank that can be utilized during a wash cycle. Further, embodiments of the present subject matter may advantageously detect additive levels of the two or more tanks and switch the active tank to another tank when necessary to complete a wash cycle (e.g., automatically or without direct user input, knowledge, or intervention).

Additionally or alternatively, embodiments of the present subject matter may advantageously choose which tank to utilize based on a load size of a load of articles within the basket or the additive level of the two or more tanks. For example, embodiments of the present subject matter may advantageously utilize a first tank for larger loads of articles and a second tank for smaller loads of articles. In such instances, the first tank can be a larger tank and the second tank can be a smaller tank.

Additionally or alternatively, embodiments of the present subject matter may advantageously alternate usage of all available tanks between subsequent wash cycles to even out the usage of the two or more tanks.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a washing machine comprising a cabinet, a tub provided in the cabinet, a basket rotatably provided within the tub, and a bulk additive storage system comprising two or more tanks, the method comprising:

receiving an input indicative of a first set of desired wash cycle options to be performed by the washing machine;

selecting an active tank of the two or more tanks based on the first set of desired wash cycle options; and supplying a dose of additive to the tub from the active tank, wherein the dose of additive is based on the first set of desired wash cycle options.

2. The method of claim 1, wherein selecting the active tank of the bulk additive storage system comprises sensing an additive level of a first tank of the two or more tanks and comparing the sensed additive level of the first tank to a predetermined additive threshold, wherein the predetermined additive threshold corresponds to a volume of additive needed to perform the first set of desired wash cycle options.

3. The method of claim 2, wherein selecting the active tank further comprises:

determining, based on the comparison of the additive level of the first tank to the predetermined additive threshold, the additive level of the first tank is greater than or equal to the predetermined additive threshold, and selecting the first tank as the active tank.

4. The method of claim 2, wherein selecting the active tank further comprises:

determining, based on the comparison of the additive level of the first tank to the predetermined additive threshold, the additive level of the first tank is less than the predetermined additive threshold, and selecting a second tank as the active tank.

5. The method of claim 1, wherein selecting the active tank of the bulk additive storage system comprises:

determining a load size of a load of articles held within the basket, and comparing the determined load size to a load size threshold.

6. The method of claim 5, wherein selecting the active tank further comprises:

determining, based on the comparison of the load size of the load of articles held within the basket to the load size threshold, the load size of the load of articles held within the basket is greater than or equal to the load size threshold, sensing an additive level of a first tank of the two or more tanks, and comparing the sensed additive level of the first tank to a predetermined additive threshold, wherein the predetermined additive threshold corresponds to a volume of additive needed to perform the first set of desired wash cycle options.

7. The method of claim 6, wherein selecting the active tank further comprises:

determining, based on the comparison of the sensed additive level of the first tank to the predetermined additive threshold, the sensed additive level of the first tank is greater than or equal to the predetermined additive threshold, and selecting the first tank as the active tank.

8. The method of claim 6, wherein selecting the active tank further comprises:

determining, based on the comparison of the sensed additive level of the first tank to the predetermined additive threshold, the sensed additive level of the first tank is less than the predetermined additive threshold, and selecting a second tank as the active tank.

9. The method of claim 5, wherein selecting the active tank further comprises:

determining, based on the comparison of the load size of the load of articles held within the basket to the load size threshold, the load size of the load of articles held within the basket is less than the load size threshold, sensing an additive level of a second tank of the two or more tanks, and comparing the sensed additive level of the second tank to a predetermined additive threshold, and wherein the predetermined additive threshold corresponds to a volume of additive needed to perform the first set of desired wash cycle options.

10. The method of claim 9, wherein selecting the active tank further comprises:

determining, based on the comparison of the sensed additive level of the second tank to the predetermined additive threshold, the sensed additive level of the second tank is greater than or equal to the predetermined additive threshold, and selecting the second tank as the active tank.

11. The method of claim 9, wherein selecting the active tank further comprises:

determining, based on the comparison of the sensed additive level of the second tank to the predetermined additive threshold, the sensed additive level of the second tank is less than the predetermined additive threshold, and selecting a first tank as the active tank.

12. The method of claim 1, wherein selecting an active tank further comprises:

selecting a first tank as the active tank of the bulk additive storage system, receiving an input indicative of a second wash cycle command, wherein the input is received after the dose of additive is supplied to the tub, selecting a second tank as the active tank of the two or more tanks based on the second was cycle command, and supplying a dose of additive to the tub from the active tank.

13. A washing machine appliance comprising:

a cabinet;

a tub provided within the cabinet;

a basket rotatably provided within the tub and configured to hold a load of articles;

a bulk additive storage system provided in the cabinet, the bulk additive storage system comprising two or more tanks; and a controller operable for:

receiving an input indicative of a first set of desired wash cycle options to be performed by the washing machine appliance;

selecting an active tank of the two or more tanks based on the first set of desired wash cycle options;

supplying a dose of additive to the tub from the active tank, wherein the dose of additive is based on the first set of desired wash cycle options.

14. The washing machine appliance of claim 13, wherein selecting the active tank of the bulk additive storage system comprises sensing an additive level of a first tank of the two or more tanks and comparing the sensed additive level of the first tank to a predetermined additive threshold, wherein the predetermined additive threshold corresponds to a volume of additive needed to perform the first set of desired wash cycle options.

15. The washing machine appliance of claim 14, wherein selecting the active tank further comprises:

determining, based on the comparison of the additive level of the first tank to the predetermined additive threshold, the additive level of the first tank is greater than or equal to the predetermined additive threshold, and selecting the first tank as the active tank.

16. The washing machine appliance of claim 14, wherein selecting the active tank further comprises:

determining, based on the comparison of the additive level of the first tank to the predetermined additive threshold, the additive level of the first tank is less than the predetermined additive threshold, and selecting a second tank as the active tank.

17. The washing machine appliance of claim 13, wherein selecting the active tank of the bulk additive storage system comprises:

determining a load size of a load of articles held within the basket, and comparing the determined load size to a load size threshold.

18. The washing machine appliance of claim 17, wherein selecting the active tank further comprises:

determining, based on the comparison of the load size of the load of articles held within the basket to the load size threshold, the load size of the load of articles held within the basket is greater than or equal to the load size threshold, sensing an additive level of a first tank of the two or more tanks, and comparing the sensed additive level of the first tank to a predetermined additive threshold, wherein the predetermined additive threshold corresponds to a volume of additive needed to perform the first set of desired wash cycle options.

19. The washing machine appliance of claim 13, wherein selecting an active tank further comprises:

selecting a first tank as the active tank of the bulk additive storage system, receiving an input indicative of a second wash cycle command, wherein the input is received after the dose of additive is supplied to the tub, selecting a second tank as the active tank of the two or more tanks based on the second was cycle command, and supplying a dose of additive to the tub from the active tank.

* * * * *